United States Patent [19]

Frantl et al.

[11] 4,011,020

[45] Mar. 8, 1977

[54] TRANSFER JOINT FOR RIGID FRAMES

[76] Inventors: Erich Frantl, Gablenzgasse 24, A-1160 Vienna; Peter Hofstätter, Kollergerngasse 6, A-1060 Vienna; Willibald Zemler, Ospelgasse 34, A-1200 Vienna, all of Austria

[22] Filed: Feb. 13, 1975

[21] Appl. No.: 549,797

[30] Foreign Application Priority Data

Feb. 20, 1974 Austria ..... 1398/74

[52] U.S. Cl. ..... 403/172; 403/218; 403/267; 403/268

[51] Int. Cl.[2] ..... F16B 7/00

[58] Field of Search ..... 403/266, 267, 268, 265, 403/269, 218, 171, 172, 176, 170; 52/722, 725, 726; 285/294, 297, 137

[56] References Cited

UNITED STATES PATENTS

| | | | |
|---|---|---|---|
| 1,689,281 | 10/1928 | Forssell | 403/268 |
| 3,422,592 | 11/1969 | Gjerde | 403/267 X |
| 3,552,787 | 1/1971 | Yee | 52/722 X |

FOREIGN PATENTS OR APPLICATIONS

| | | | |
|---|---|---|---|
| 857,228 | 4/1940 | France | 285/137 R |
| 958,701 | 2/1957 | Germany | 285/297 |

*Primary Examiner*—Andrew V. Kundrat
*Attorney, Agent, or Firm*—Wenderoth, Lind & Ponack

[57] ABSTRACT

The invention relates to a transfer joint for rigid frames comprising a solid joint member, the interior of which is made of hardened grout and has three or more bars joined to it with a non-positive and/or positive connection.

17 Claims, 10 Drawing Figures

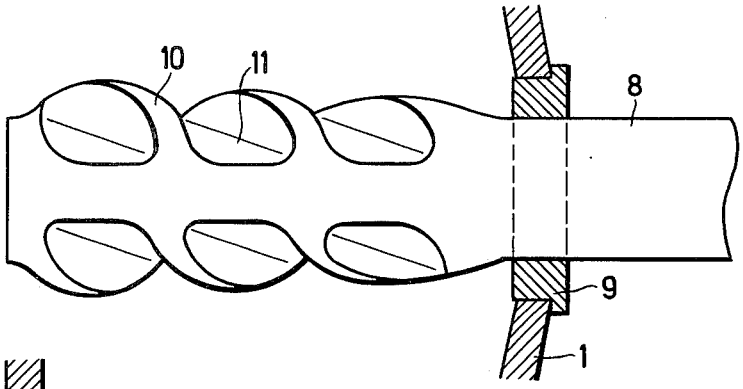
Fig. 3
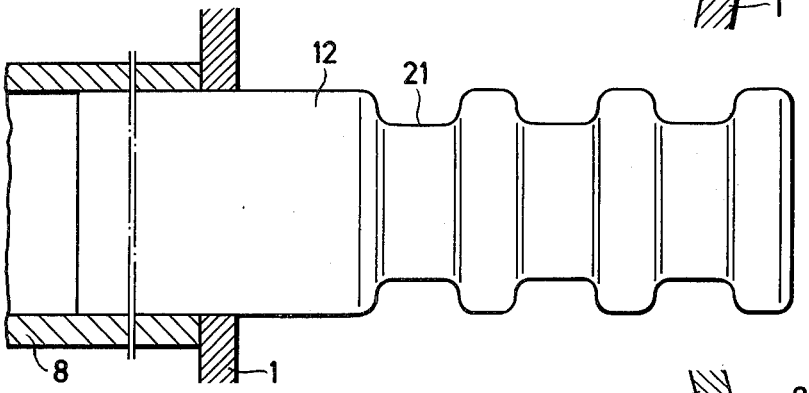
Fig. 4
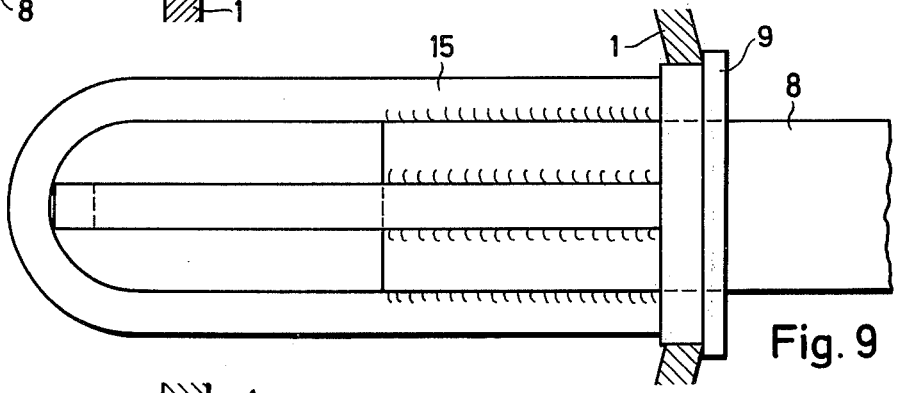
Fig. 9
Fig. 10
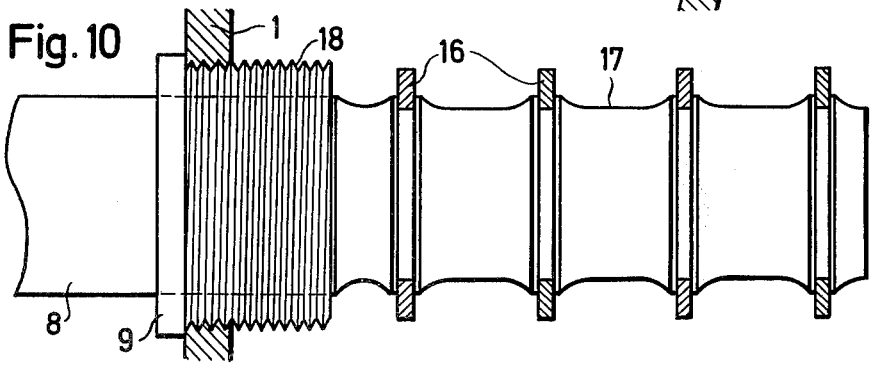

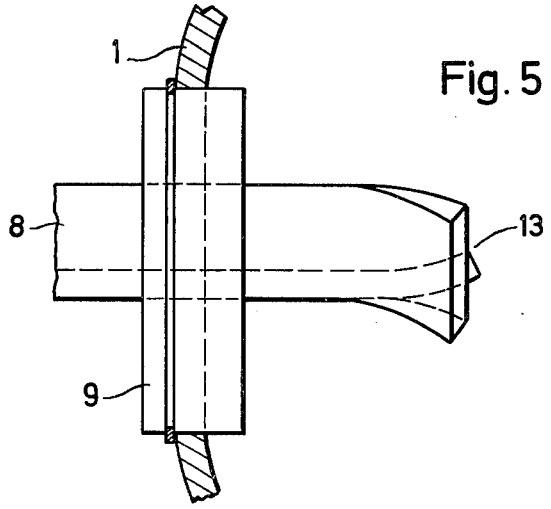
Fig. 5
Fig. 6
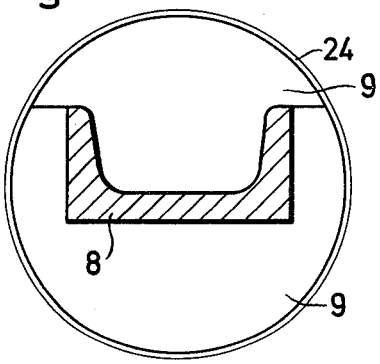
Fig. 7
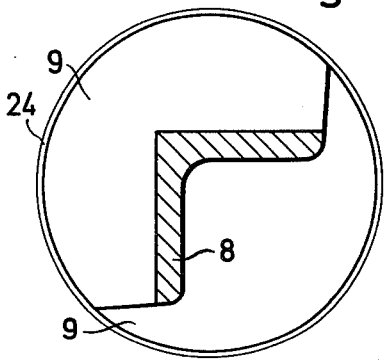
Fig. 8
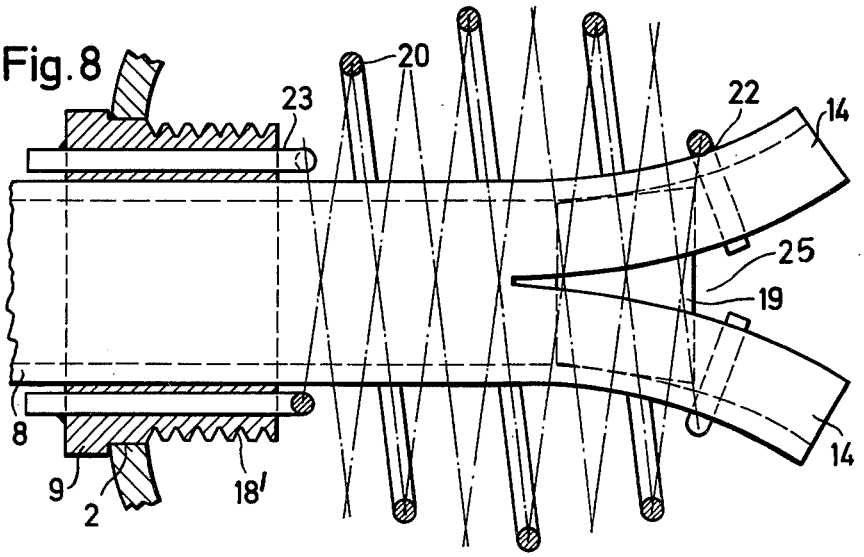

TRANSFER JOINT FOR RIGID FRAMES

BACKGROUND OF THE INVENTION

A transfer joint of this type is known e.g. from East German Pat.DL-PS No. 55,868. This proposes a dish-shaped or ball-shaped transfer joint of material which can be cast or moulded and which should advantageously be non-metallic. Bushes with internal threads or thread bolts are inserted in the joint to enable it to receive appropriate bars. The joint is made by placing the connecting pieces such as bushes or thread bolts in a and mould then filling the mould with casting material or by moulding in the connecting pieces as inserts in a mouldable material with the aid of the mould.

The disadvantage of such a joint is that although the grouting materials in question have good resistance to pressure they have only relatively slight tensile strength. This means that such joints can only be used when one is sure that the bars connected by them have only to absorb weak tensile forces.

Another drawback of such joint is that it requires special connecting pieces and appropriate shaping of the ends of the bars, usually in the form of thread bolts. This involves a corresponding outlay on production and also makes assembly more difficult, since it can only be carried out in accordance with a suitably detailed plan if bars threaded at both ends are used.

SUMMARY OF THE INVENTION

The object of the invention is to provide a transfer joint which is suitable both for bars which are heavily loaded in compression and bars which are heavily loaded in tension, and where no special connecting pieces are required.

According to the invention this is achieved in that the joint member comprises a metal casing which forms the casting mould for the grout and which contains holes for insertion of the bars before the grout has set, and that casing has a rigid connection with the hardened grout, which enables forces to be transferred through the transfer joint.

The rigid connection between the grout and the metal casing is achieved by loading the grout in compression even when the bars are loaded in tension. A pressure cone forms in the part of the grout surrounding the tensioned bar and rests against the interior of the casing, causing the casing to absorb the tensile forces. However, compressive loads on the grout can also be increased since the casing prevents any migration of the grout in a plane perpendicular to the direction of the force.

Another advantage of the joint according to the invention is that the bars can be rapidly and securely linked with the joint members on the building site and that no complicated assembly plan is required to construct a rigid frame since, as e.g. in the case of a welded construction, it is immaterial which end of the bar is inserted in the corresponding joint. It is an advantage to provide the ends of the bars with recesses and/or projections in order to achieve a positive connection between the bars and the grout. In such cases and in the case of bars of a noncircular cross-section or even of a cross-section which increases towards the end, it is helpful to provide circular holes in the casing and to insert centering discs, preferably of divided construction, in these holes. Divided centering discs may be mounted in a radial direction on the bar already inserted in the casing and then pressed or screwed into the hole.

Centering discs provide a suitable guide for the bars and prevent the grout from flowing out, particularly in the case of non-circular bars.

If relatively large joint members are required and particularly if grouting materials of low tensile strength are used, it is advisable to fit reinforcements, which are preferably joined to the casing, during the manufacture of the joint member. Strength can be increased in this way. The internal surface of the hollow member may also be provided with elements appropriate to transfer forces, so that a clamping effect can be obtained between the grout and the hollow member as in a "composite construction".

The grout may consist of plastics, particularly fibreglass-reinforced plastics, high grade concrete or plastic mortars, possibly reinforced with asbestos fibers or with granulated metal, solder metals, glass and similar materials added to them. The grouts may be cast in by the action of gravity or injected under pressure.

For example, for joints which are entered predominantly by pressure bars — in addition to bars loaded moderately in tension, inserted to considerable depth and with their ends shaped to allow a positive connection to the grout — as in the case with single-shell bar grating cupolas and single-shell bar grating domes, it is possible to use conventional concrete mortar with a compressive strength from 600 to 800 kp/cm$^2$ after 28 days'hardening. The composition of such a mortar might comprise e.g. 1 part by weight high grade Portland cement (preferably Austrian Standard PZ 475), 2.5to 4 parts by weight of sand within grain limits 0.06 to 2 mm, which may be stirred with about 0.6 part by weight of water. In order to increase resistance to shearing, part of the coarse-grained parts of the sand, of grain size 1 to 2 mm, may be replaced by equal proportions (by volume) of granulated steel. Depending on requirements, optimum mixing ratios and screen lines may be planned for each specific case by testing samples for suitability.

The concrete mortars can preferably be injected into the casing at fairly high pressures instead of being poured in, in order to obtain a casting which is (a) as far as possible free from shrinkage because of the low water content and (b) as far as possible free of air pores.

For joints with bars which are highly loaded in tension specially shrink-proof mortar mixtures must be used if a suitably strong bond is to be obtained between the grout and the casing. For ecample, a cememt mixture in accordance with Austrian Pat. No. 298,321 may be used for such a purpose, although other shrink-proof concrete cement mixes on the market are also suitable.

A plastics mortar, preferably based on epoxy resin, may be used instead of concrete mortar. A plastics mortar of this type comprises e.g. a bonding agent making up 15 to 20% of the volume. The bonding agent is blended with and binds quartz sand, the grain distribution of the sand being graduated in accordance with control screen lines and part or all of the sand being replaced by granulated steel, depending on the modulus of elasticity desired. The quartz sand and/or granulated steel fillers preferably have a grain size up to about 3 mm, their function being to improve the modulus of elasticity, creep behaviour, temperature resistance and the favourable effect on reaction shrinkage. Granulated steel The epoxy resin "Araldit GY 254", manufactured and marketed by Messrs. Ciba-Geigy AG of Basle, may be used e.g. as the bonding agent together with hardeners "YB 2606" or "YB 2625".

With the transfer joints according to the invention a plurality of load-bearing members may be joined at different angles enabling tensile and compressive forces as well as bending moments to be transferred. The joints may be used inter alia for multiple-chord skeleton girders, skeleton plates, rigid three dimensional frames, rigid grating frames, skeleton barrels, folded skeleton structures, single and multiple-layer skeleton cupolas and rigid frame cupolas, bar grating bearing structures and plane bearing structures.

BRIEF DESCRIPTION OF THE DRAWINGS

The invention will now be further explained with reference to the accompanying drawings, wherein:

FIGS. 3, 4, 5, 8, 9 and 10 illustrate embodiments of the end portions of the bars according to the invention, and FIGS. 6 and 7 are examples of the construction of centering discs according to the invention.

DETAILED DESCRIPTION OF THE INVENTION

Figure 1:
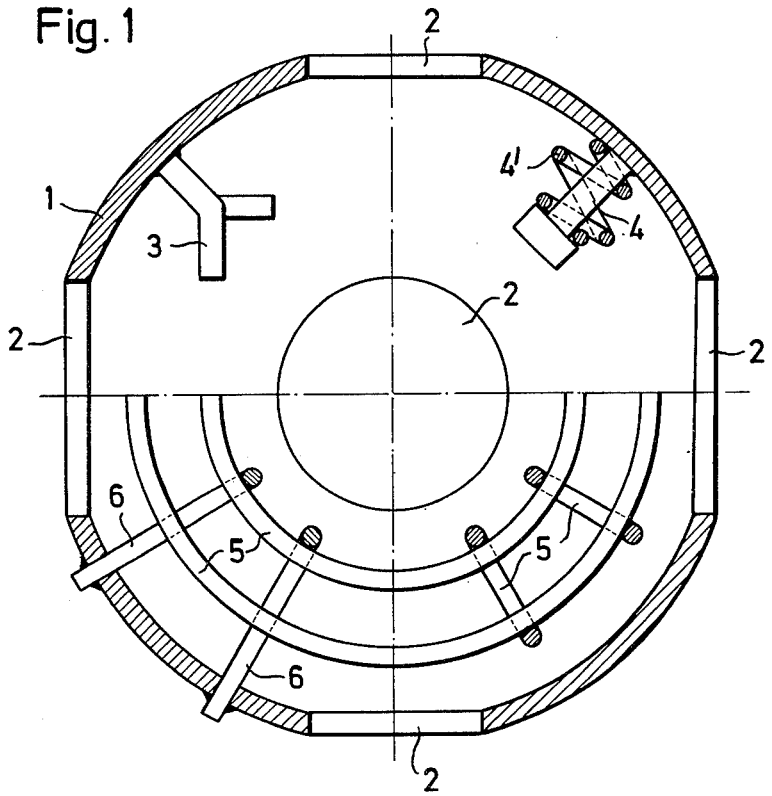
FIG. 1 is a section through the casing of a joint member according to the invention.
Figure 2:
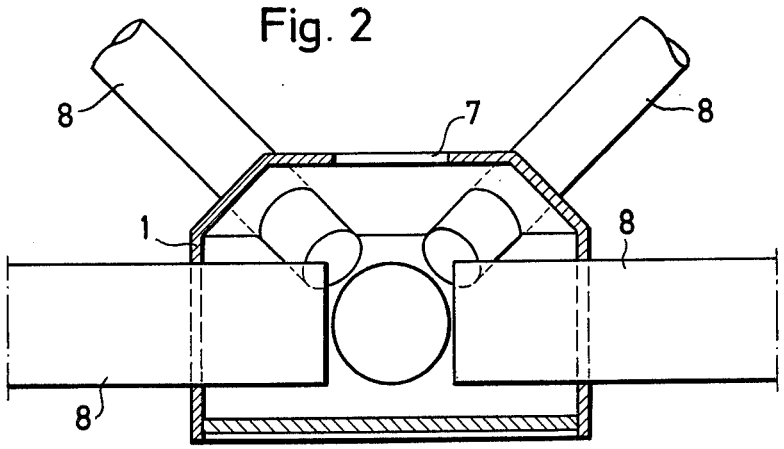
FIG. 2 is a section through a transfer joint according to the invention

The casing 1 of a joint member according to the invention is shown in section in FIG. 1. Attachments 3 and 4 to improve the clamping of the casing to the grout are shown in the upper half of the Figure, and an example of the insertion of a reinforcement 5 is shown in the lower half. Attachment 3 has a free end which is divided, and the attachment is welded to the inside of the casing 1. The attachments for clamping the grout to the casing 1 may be shaped differently, e.g. like the attachment 4 in FIG. 1 where the shank also has a spiral 4' wound around it, thus providing a very good clamping action.

The reinforcement 5 comprises concentric rings connected by bridges. In order to obtain particularly high strength, reinforcement 5 is joined to the casing 1 by struts 6. The reinforcement 5 is inserted and/or joined to the casing 1 during the manufacture of the casing, which may have any shape. Reinforcements are appropriate particularly when the transfer joints are heavily loaded and when the grouts used do indeed have good resistance to compression but only poor tensile strength as in the case of conrete mortar.

The bars 8 are inserted in the joint member through holes 2, one hole being left free and acting as a pouring aperture 7. It is of course also possible for highly stressed bars to be guided through the joint member.

When the bars, which may be of any cross-sectional shape, have been inserted in the joint member, the joint member is filled by pouring grout into it or injecting it under pressure. It is an advantage to use grouts which will not shrink during hardening but which will rather expand. Where hot-cast materials are used it is an advantage to make the casing of a material which will expand more, at the casting temperatures used for the grout, than the grout will shrink during setting, so that the casing 1 will always be loaded in tension. The use of grouts which increase in size relative to the casing 1 also produces high adhesive stress at the bars 8 and consequently high resistance to extraction, so that the transfer joint can be appropriately loaded in tension. In the case of pure pressure or bending connections on the other hand, the bars are supported by having their ends or side surfaces seated on the cast member.

If the joint is exposed to high tensile forces it is an advantage to have not only a non-positive but also a positive connection between the bars and the grout. Examples of how the ends of the bars may be shaped in order to provide a positive connection between the bar 8 and the grout are shown in FIGS. 3, 4, 5, 8, 9 and 10. In the FIG. 3 example the end of the bar 8 is provided with a head which has raised portions 10 and recessed or lowered portions 11, the height of the raised portions 10 decreasing from the end towards the centre of the bar. A centering disc 9 is provided to centre the bar 8 in the hole in the casing 1. The disc 9 is either of divided construction or consists of one piece which is pushed onto the head of the bar before it is forged together.

If the bars 8 are tubular they must be sealed before the joint member is cast. This can be done, e.g. as shown in FIG. 4, by using an end piece 12 which is inserted in the tube and joined to it. The free end of the piece 12 is provided with corrugations 21 in order to achieve a positive connection.

Instead of fastening a tubular bar to the outside of the casing 1 of the joint member, it is also possible for the ends of the tube to be pressed flat and bent over. It is then advantageous to use centering discs. These may either be in the form of divided discs which are placed on the ready-deformed bar in a radial direction and pressed or screwed into the hole in the casing, or they may be discs in one piece which are pushed onto the bar before the ends are deformed and which are inserted in the hole when the bar has been placed in the joint member.

With bars 8 of non-circular cross-section the use of centering sleeves 9 is again very advantageous since it avoids the necessity of the provision in the casing of apertures adapted to the cross-section of the bars. Such specially shaped apertures are very costly to produce and therefore expensive, whereas apertures for the bars 8, particularly with divided centering discs where the components can be held together by spring rings 24 as illustrated e.g. in FIGS. 6 and 7, are far easier and cheaper to obtain. In order to achieve a positive connection between the grout and a bar 8 of non-circular cross-section, it is advisable to deform the end 13 of such a bar, e.g. as shown in FIG. 5 with reference to a bar having an L-shaped profile, to slit the end portion and to spread open the profiled sections.

Other possible shapes for the ends of the bars 8 are illustrated in FIGS. 8 to 10. Thus, as shown in FIG. 8, the end of the bar 8, which is tubular, may be incised in an axial direction, the slit 25 opened out and/or the divided ends 14 bent apart. A spreading plug 19 is provided to seal the tube and maintain the spreading action. In order to obtain a local increase in the strength of the grout the bar 8 is provided with a double spiral reinforcement 20. The ends 22 of the reinforcement are looped around the spread-out ends 14 of the bar 8 and the other ends 23 of the reinforcement are anchored in the centering sleeve 9, which has corrugations 18' but which is seated in a smooth hole in the casing 1. Before it is mounted the spiral reinforcement 20 has an external diamter which is smaller than the diameter of the hole 2. When the bar 8 has been placed in the joint member, the spacing disc 9, which is seated loosely on the bar 8 and joined to the ends 23 of the reinforcement 20 fixed to the splayed-out ends 14 of the bar, is turned in the direction of the pitch of reinforcement 20. This causes the diameter of the reinforcement 20 to increase and the reinforcement to take on a pear-like shape. In this way the favourable formation of a pressure cone within the grout is achieved when tensile forces act on the bar 8.

A positive connection between the bars 8 and the grout may be obtained by mounting components on the ends of the bars instead of by deforming the bars. As shown in FIG. 9, for example, a cage 15 made of square material may be fixed to the end of the bar. This can advantageously be done in an axial direction by means of welded seams. Such seams cause virtually no reduction in the cross-section of the bar 8 and, if they are of suitable length, tensions in the seams can be kept to a minimum.

Another way of fitting components which will provide a positive connection in the end portions of the bars 8 is illustrated in FIG. 10. The bar 8 is provided with grooves to receive split rings, e.g. Seeger rings 16, and possibly with grooves 17 to improve the tension gradient in the bar 8. The use of a centering disc 9 which is provided with thread 18 and screwed into the casing 1 makes it possible for forces to be diverted into the casing 1 by way of the centering sleeve, which is positively connected to the grout and to the casing 1.

It is not always necessary for the bars 8 to be anchored in the grout with a positive connection, but it is an advantage to use bars with a relatively rough surface at least at the ends in order to obtain a good adhesive connection.

The joint members may be either open members or closed members provided with a pouring aperture, which are filled with the grout once the bars 8 have been inserted.

Transfer joints which are very rigid and resistant to bending are obtained with the joints according to the invention. This has great advantages, particularly in view of the problems of stability with single-layer bar gratings and single-layer bar cupolas, since with single loads which may cause the joints to move into the other state of stability the elbow lever action can be avoided by joints which are resistant to bending. In addition, the bar-connecting point is no longer eccentric relative to the centre of the joint in the transfer joints according to the invention. In contrast with most known transfer joints therefore, those according to the invention are not in danger of tipping, since they have no hinge points or hinge-like points outside the centre of the joint. Another advantage of the transfer joint according to the invention is that it avoids any reduction in the cross-section of the bars at the critical or connecting points.

We claim:

1. A transfer joint for rigid frames comprising:

a solid joint member including a hollow metal casing having a wall with an outer surface which is substantially convex and an inner surface which is substantially concave, said casing being filled with a hardened grout material, said casing having a rigid connection with said hardened grout material, said casing having a plurality of substantially two-dimensional openings extending through said wall thereof;

at least three longitudinal bars extending into said casing, one each through a respective one of said openings, toward a common point of intersection within said casing, each of said bars having a portion within said casing embedded in said hardened grout material, the cross-sectional area of each of said bars at the area thereof passing through said wall of said casing being substantially undiminished from the cross-sectional area thereof exterior said casing, and each of said bars having an end portion within the interior of said casing which has at least some surface areas diverging from the longitudinal direction of said bar; and a grout addition hole, extending through said wall of said casing, said grout addition hole being located to provide a free and unrestricted path to the ends of said longitudinal bars.

2. A joint as claimed in claim 1, wherein said grout material comprises a concrete mortar containing granulated metal.

3. A joint as claimed in claim 1, wherein said grout material comprises a sand mixture bonded with a curable plastics material such as an epoxy resin.

4. A joint as claimed in claim 3, wherein said sand mixture contains granulated metal.

5. A joint as claimed in claim 1, wherein said grout material comprises a fiberglass-reinforced plastics material.

6. A joint as claimed in claim 1, wherein said grout material comprises an asbestos-reinforced concrete mortar.

7. A joint as claimed in claim 1, further comprising reinforcement members attached to said casing and embedded in said grout.

8. A joint as claimed in claim 1, wherein each of said bars has a cross-sectional configuration which is uniform throughout a length of said bar including the portion thereof exterior of said casing and the portion thereof passing through said wall of said casing.

9. A joint as claimed in claim 1, wherein said openings are round, and further comprising a plurality of centering discs, one each extending into one of said openings, one of said bars extending through a respective one of said centering discs, said discs cooperating with said wall and the respective said bars to close said respective openings.

10. A joint as claimed in claim 9, wherein the cross-sectional profile of said bars is non-circular.

11. A joint as claimed in claim 10, wherein said cross-sectional profile is L-shaped.

12. A joint as claimed in claim 10, wherein said cross-sectional profile is channel-shaped.

13. A joint as claimed in claim 10, wherein said bar is solid.

14. A joint as claimed in claim 9, wherein each of said bars is tubular.

15. A joint as claimed in claim 9, wherein said centering discs are each of divided construction.

16. A joint as claimed in claim 1, wherein said end portion of each of said bars comprises a deformation of the cross-section thereof.

17. A joint as claimed in claim 1, wherein said end portion of each of said bars comprises an additional member attached thereto.

* * * * *